United States Patent [19]

Imahashi

[11] 4,263,753

[45] Apr. 28, 1981

[54] INTERCHANGEABLE FACETING APPARATUS WITH REVERSIBLE DUAL INDEXING MECHANISM

[76] Inventor: Takahiro Imahashi, 21-25, Higashimotomachi 3-chome, Kokubunji City, Tokyo, Japan

[21] Appl. No.: 22,355

[22] Filed: Mar. 20, 1979

[30] Foreign Application Priority Data

Oct. 9, 1978 [JP] Japan ..... 53-124299
Oct. 13, 1978 [JP] Japan ..... 53-141268[U]

[51] Int. Cl.[3] ..... B24B 9/16
[52] U.S. Cl. ..... 51/229
[58] Field of Search ..... 51/229, 125, 216 R

[56] References Cited

U.S. PATENT DOCUMENTS

| | | | |
|---|---|---|---|
| 1,313,402 | 8/1919 | Mantle | 51/229 |
| 2,542,698 | 2/1951 | O'Brien | 51/229 |
| 3,135,073 | 6/1964 | Odle | 51/229 |
| 3,559,349 | 2/1971 | Imahashi | 51/229 |
| 3,812,629 | 5/1974 | Campbell | 51/216 R |
| 3,940,888 | 3/1976 | Wain | 51/229 |

FOREIGN PATENT DOCUMENTS

| | | | |
|---|---|---|---|
| 559628 | 8/1957 | Belgium | 51/229 |

*Primary Examiner*—Harold D. Whitehead
*Attorney, Agent, or Firm*—Wenderoth, Lind & Ponack

[57] ABSTRACT

Interchangeable faceting apparatus comprises a reversible dual indexing mechanism consisting of a primary indexing gear with a small number of notches and an auxiliary indexing gear controlling the primary gear, and a height adjusting mechanism which permits a faceter frame to be precisely positioned with respect to the lap surface at any height of the faceter frame. The primary indexing gear with a relatively small number of notches engaged by a spring trigger provide subdivided indexes by the action of the auxiliary indexing gear.

11 Claims, 11 Drawing Figures

INTERCHANGEABLE FACETING APPARATUS WITH REVERSIBLE DUAL INDEXING MECHANISM

BACKGROUND OF THE INVENTION

1. Field of the Invention

The present invention relates to a faceting apparatus for cutting gemstones, and more particularly to an interchangeable faceting apparatus which comprises a dual indexing means consisting of a primary indexing gear with a relatively small number of notches and an auxiliary indexing gear which controls the primary gear to provide subdivided indexes, and a height adjusting means for placing a faceter frame in parallel with the lap surface at any selected height of the faceter frame.

2. Description of the Prior Art

There is known to the art a faceting head structure of the type disclosed herein, which comprises index plates having 60-, 64-, 80-, and 96-notch gear wheels commonly used for faceting gemstones. According to the prior art, the trigger should be engaged accurately into each notch. However, this operation usually requires too much time and attention from the operator, and it is therefore said that the number of the notches should be smaller in order to complete the operation both in less time and with less attention. Practically, however, the indexing plates with such small number of notches reduce the number of faceting angles, in other words, faceting a gemstone is incomplete with additional facets of the gemstone left untreated. Therefore, the above conventional indexing plates cannot satisfy practical needs.

The faceting head assembly known to the art includes a height adjusting device which adjusts the height of the faceting frame with respect to the lap surface. The height adjusting device has a foot link hinged to the underside of the frame, or is of a stand-rod type in which the frame is height-adjustably mounted on one side there-of to a stand rod and is fastened thereto by means of a screw at any selected height of the frame. The operation or manipulation of the device requires a high level of experience or expertise as well as much time and attention, particularly when it requires a fine adjustment.

OBJECTS OF THE INVENTION

With the above-mentioned problems of the prior art to be considered for solution, it is a principal object of the present invention to provide a faceter head apparatus which comprises a primary indexing means consisting of a trigger and an index gear wheel and an auxiliary indexing means consisting of a worm and a worm wheel. The faceter head apparatus according to the invention can index with 1/384 or 1/360 if the index gear is equipped with 30 or 32 notches which are engaged by the trigger.

Another object of the present invention is to provide a faceter head apparatus which further has a height adjusting means in the form of a X-shaped foot link secured to the faceter frame, the X-shaped foot link having a level adjusting device which permits the faceter head precisely to be placed in parallel with the lap surface at any selected height of the head. Alternatively, the height adjusting means may comprise an attachment with a permanent magnet which removably attaches the frame to a stand rod at any desired height.

The height adjustment can be done readily and without any particular experience.

BRIEF DESCRIPTION OF THE DRAWINGS

Other objects, advantages and merits of the present invention will become apparent from the following description of several preferred embodiments shown in the accompanying drawings, in which.

DETAILS OF THE SEVERAL PREFERRED EMBODIMENTS

Figure 1:
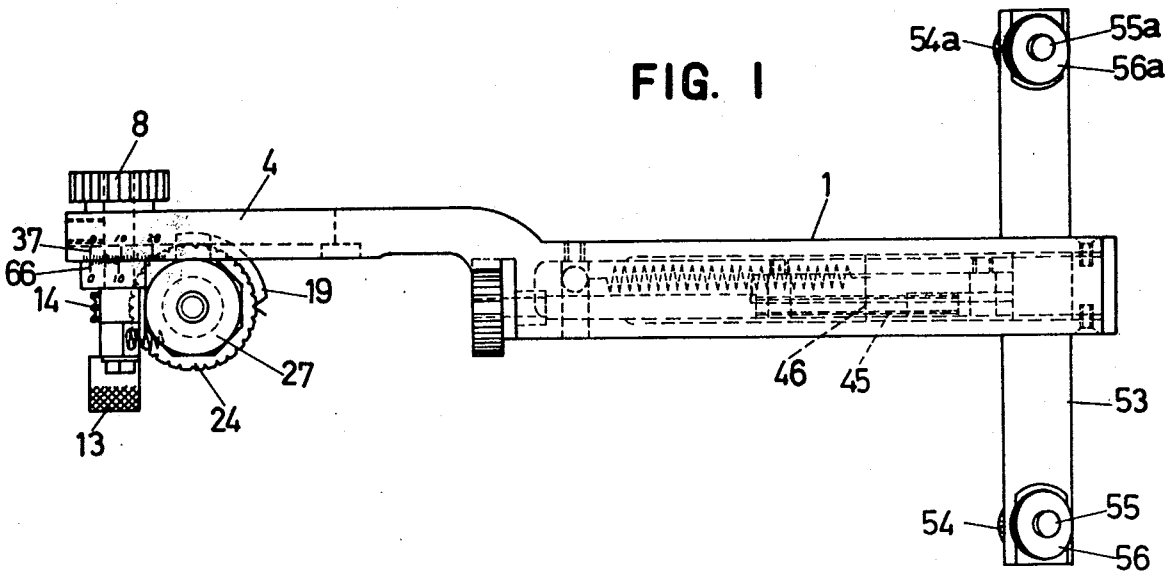
FIG. 1 is a plan view of a first preferred embodiment of the faceter head apparatus according to the present invention.
Figure 2:
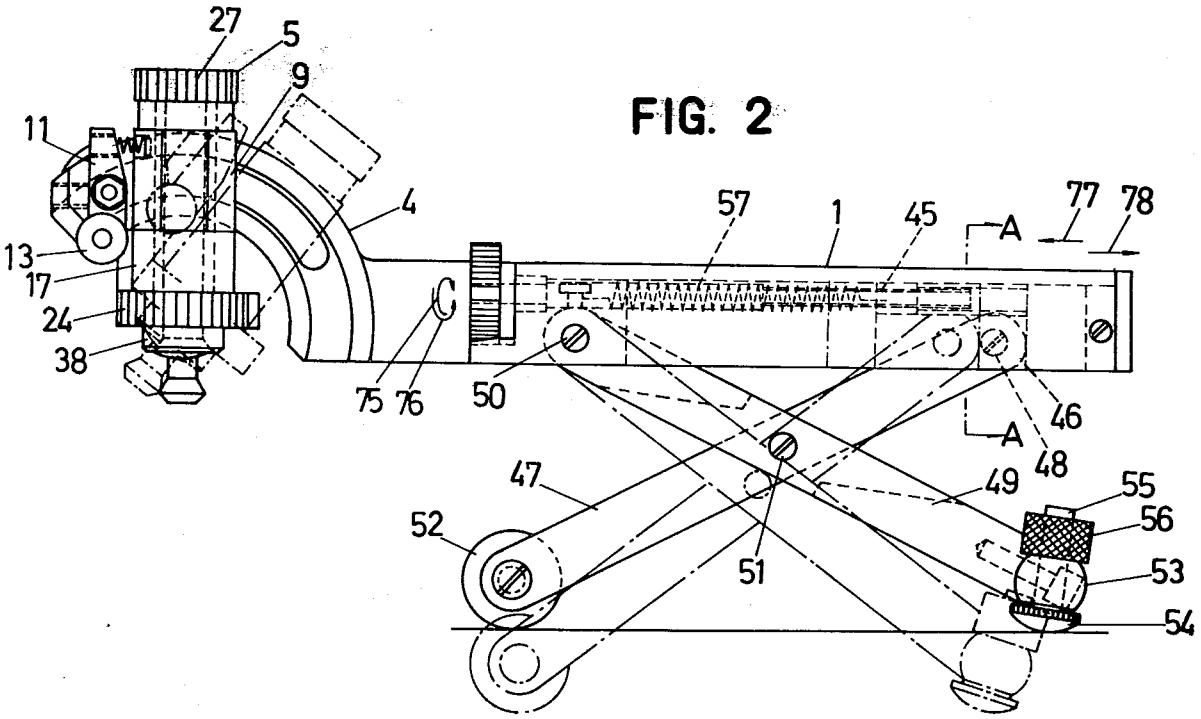
FIG. 2 is a front view of the apparatus shown in FIG. 1.
Figure 3:
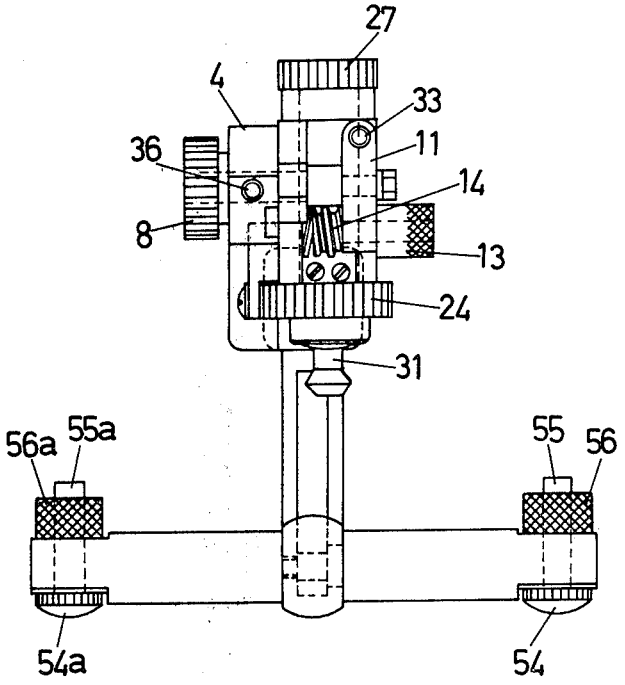
FIG. 3 is a side view of the apparatus in FIG. 1.
Figures 7, 8, 9:
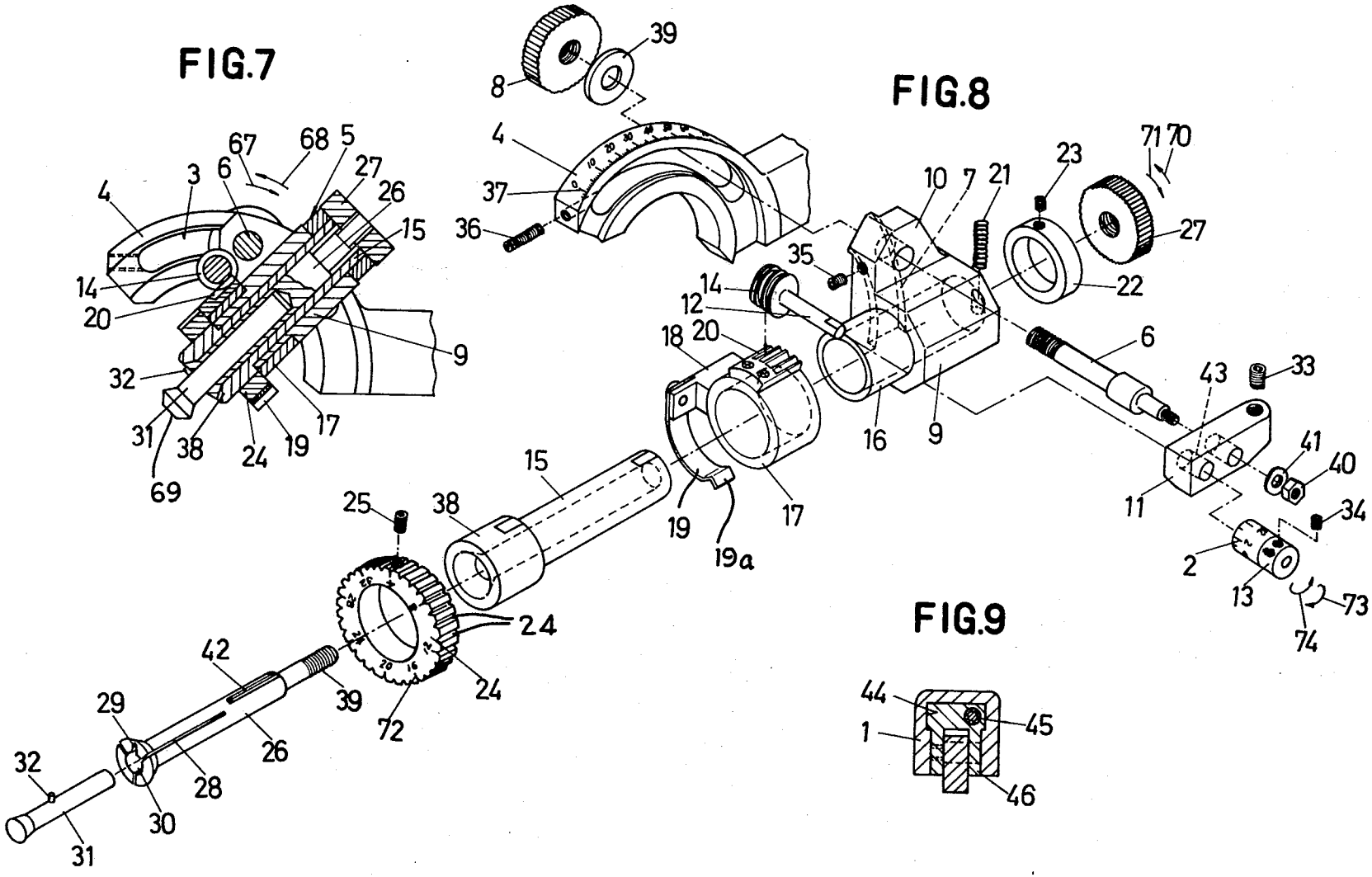
FIG. 7 is a cross-sectional view of the apparatus according to the invention, showing how the faceter head is mounted in the apparatus.
FIG. 8 is a perspective exploded view illustrating the main component parts or elements of the apparatus including the faceter head assembly.
FIG. 9 is a cross-sectional view taken along the line A—A in FIG. 2.

Referring first to FIGS. 1, 2 and 8, a first preferred embodiment of the invention will now be described in more detail. A faceter frame 1 has a substantially rectangular form extending along the length thereof and has a channel cross-section. A faceter head mounting arcuate-shaped member 4 extends on one side from the frame 1, the member 4 having an arcuate groove along the length thereof, the groove having an arcuate elongated opening 3 (FIG. 7) for accommodating a shaft 6 which supports a faceting head assembly 5. The faceting head assembly 5 includes an arcuate-shaped protruded guide member 7 which is profiled similarly to the above-mentioned groove in the member 4 and closely fits in the groove. One end of the shaft 6 passing through the aperture 3 has a nut 8 for fastening the assembly 5 to the member 4. The head assembly 5 includes a main bearing 9 equipped with a portion 10 which has a hole for receiving the shaft 6. The shaft 6 has at a other end thereof a worm shaft bearing 11 which has a hole for receiving the shaft 6 and a hole for the worm shaft 12. The worm shaft 12 is rotatably mounted to the bearing 11, and has at the end thereof passed through the bearing 11 a knob 13 with a scale indicator 2 and at the other end a worm 14. The main bearing 9 has an aperture perpendicular to the hole of the shaft 6 for accommodating a main shaft 15, and has on one side thereof a cylindrical member 16 around which a trigger ring 17 rotatably fits. The trigger ring 17 has an outwardly extending bracket 18 to which a spring trigger 19 is secured. A worm wheel 20, which is a wheel piece forming a part of the worm wheel gear assembly, is mounted to the trigger ring 17. The worm wheel 20 meshes with the worm 14 which is always urged by means of a spring 21 loaded between the main bearing 9 and the worm shaft bearing 11 toward the worm wheel 20. As mounted through the parts 17, 16 and 19, the main shaft 15 has one end projecting through the bearing 9, to which end a collar 22 is mounted and is secured to the shaft 15 by means of a screw 23. The main shaft 15 has at the other end thereof a diametrically-enlarged portion 38 to which an index gear 24 is secured by means of a screw 25. A collet chuck 26 is inserted through the main shaft 15 with one end thereof projecting through the main bearing 9 by way of the intermediate parts. The collet chuck 26 has a key way 42, and is secured to the main shaft 15 by means of a key. The projecting end of the collet chuck 26 on the side of the collar 22 is threaded as shown at 39, and an internally-threaded and knurled collet nut 27 attaches to the threaded end 39. The other end of the collet chuck 26 has three equally-spaced splits or slots 28 extending along the axial direction of the chuck 26, and includes a slot 29 formed in the end. The collet chuck 26 has a central hole 30 into which a dop stick 31 is inserted, the dop stick 31 having thereon a pin 32 which registers with the slot 29 in the chuck 26 and is thereby locked in place. In the drawings, reference numeral 33 denotes an adjusting screw for the spring 21; 34 and 35, screws for fastening the knob 13 and the member 10, respectively; 36, a zero-point adjusting stop; 37, a scale indicator on the arcuate member 4; 39, a washer between the nut 8 and the member 4; 40, a nut for fastening the shaft 6 to the worm bearing 11; 41, a washer between nut 40 and bearing 11; and 43 denotes a reference line on the worm bearing 11 with which the indicator 2 is to be aligned.

Figure 4:
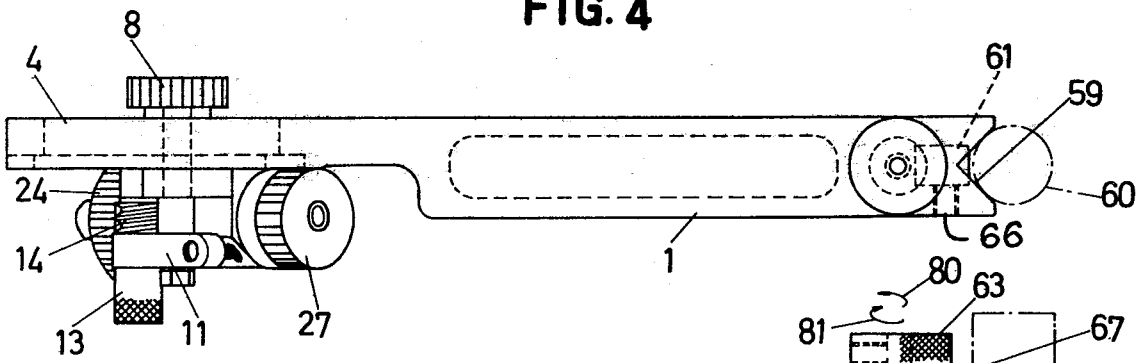
FIG. 4 is a plan view of a second preferred embodiment of the apparatus according to the invention.
Figure 5:
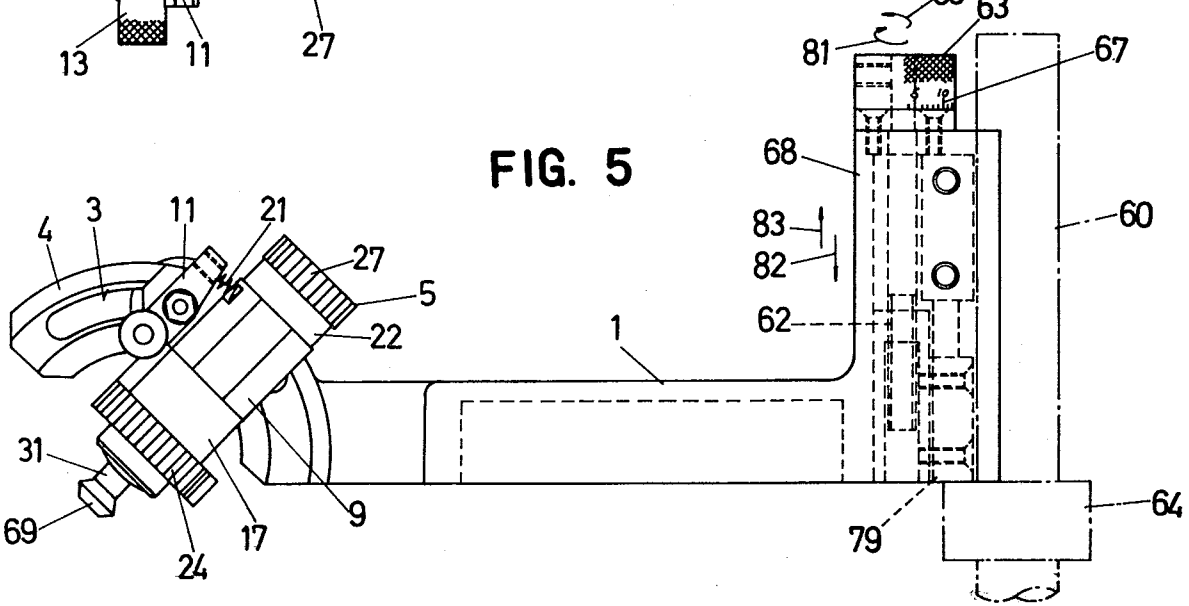
FIG. 5 is a front view of the apparatus in FIG. 4.
Figure 6:
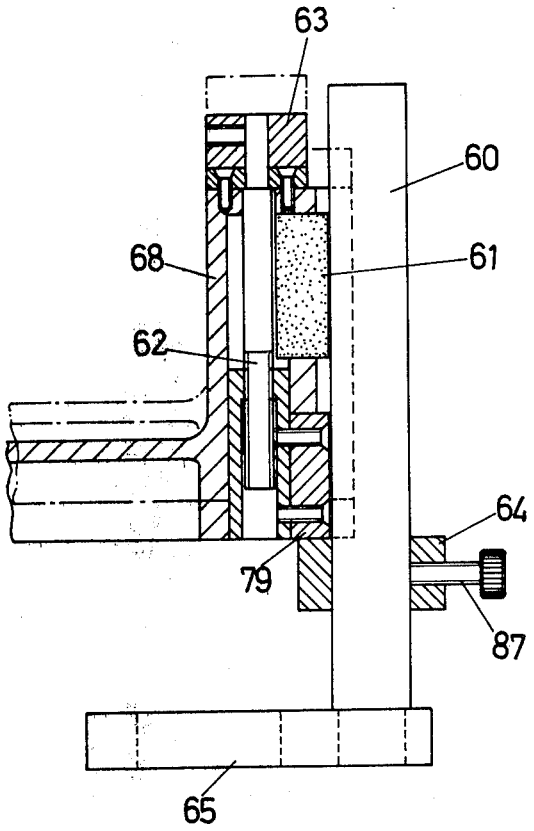
FIG. 6 is a cross-sectional view of the apparatus in FIG. 4 showing how the faceter frame is attached to the stand rod.

The faceter frame 1 has an elongated rectangular form as shown in FIG. 2, having a longitudinal channel-shaped section 44 open from below, see FIG. 9. A longitudinal threaded member 45 is movably supported in the channel 44, and a sliding member 46 is connected to the member 45. A control knob 73' is connected to the member 45. One arm 47 of an X-shaped foot link is rotatably connected to the sliding member 46 by means of a hinge pin 48, and the other arm 49 is rotatably connected to the end of the channel 44 located at the extreme left in FIG. 2 by means of a hinge pin 50, the two arms 47 and 49 being pivoted to each other by means of a hinge pin 51 to form a generally X-shaped foot link. The arm 47 has a foot roller 52, made of a material such as nylon, at the free end thereof. The arm 49 has at the free end thereof a horizontal member 53 extending at right angles to the movement of the hinged arms 47 and 49 and secured to the end of the arm 49 by means of a foot bar bolt. A level adjusting means is provided at each of the opposite ends of the member 53, comprising a level adjusting bolt 55, **55*a* having a foot leveler 54, 54*a* inserted through the member 53 and an internally threaded lock nut 56, 56*a* adjustably mated with the upper threaded portion of the bolt 55, 55*a*. A spring 57 is interposed between the hinged end of the arm 49 and the sliding member 46. The above description has been made with reference to FIGS. 1 and 2 showing an X-shaped foot link height and level adjusting means. FIGS. 4 and 5 illustrates another stand rod type form of the height and level adjusting means. This embodiment is a variation of the height and level adjusting means in the earlier embodiment, but the construction of the faceting head portion is the same. Therefore, description of the latter will not be made. The faceter frame 1 has on the right side as shown in FIG. 5 a vertical member 68 having on the right side thereof a vertical cut 59 extending along the length of the member 68, the cut 59 forming a right-angled triangular channel for accommodating a stationary stand rod 60 parallel with the channel 59. The member 68 has at the upper portion a permanent magnet 61 which is embedded therein but which is partly exposed on the side of the channel 59. A threaded rod 62 is inserted into the member 68, extending from the upper to the lower ends of the member 68. The upper projecting end of the rod 62 has an adjusting knob 63 rigidly secured thereto, and the lower end is threadedly fastened to a slide nut 79 which contacts the upper end face of a collar 64 rigidly mounted to the stand rod 60. The manipulation of the control knob 63 causes the nut 79 to protract or retract, moving the faceter frame 1 up and down. In the drawing, reference numerals 65, 66, 67 and 87** designate a bracket for mounting the stand rod in a stationary position on a work table, a fastening screw for the permanent magnet, a scale on the control knob, and a fastening screw for the collar, respectively.

The operation of the apparatus illustrated herein will now be described for better understanding of the functions thereof. The worm wheel 20 and index gear 24, each having the same number of notches, form an integral part of the combination set, and it is therefore necessary to replace a set of the two parts if the index gear is to be replaced. Now, let it be assumed, for instance, that the index gear and the worm wheel each have 32 notches and the worm dial has twelve equal divisions, the resulting index number is as follows:

| | | |
|---|---|---|
| 1/32 | 1/32 × 12/12 | one full worm rotation |
| 1/48 | 1/32 × 8/12 | $\frac{2}{3}$ rotation |
| 1/64 | 1/32 × 6/12 | $\frac{1}{2}$ rotation |
| 1/96 | 1/32 × 4/12 | $\frac{1}{3}$ rotation |
| 1/128 | 1/32 × 3/12 | $\frac{1}{4}$ rotation |
| 1/192 | 1/32 × 2/12 | 1/6 rotation |
| 1/382 | 1/32 × 1/12 | 1/12 rotation |

Next, it is supposed that each of the index gear and the worm wheel has 30 notches and the worm dial has 12 equal divisions, and the index number obtained is as follows:

| | | |
|---|---|---|
| 1/30 | 1/30 × 12/12 | one full rotation of worm |
| 1/36 | 1/30 × 10/12 | 5/6 rotation |
| 1/40 | 1/30 × 9/12 | $\frac{3}{4}$ rotation |
| 1/45 | 1/30 × 8/12 | $\frac{2}{3}$ rotation |
| 1/60 | 1/30 × 6/12 | $\frac{1}{2}$ rotation |
| 1/72 | 1/30 × 5/12 | 5/12 rotation |
| 1/90 | 1/30 × 4/12 | $\frac{1}{3}$ rotation |
| 1/120 | 1/30 × 3/12 | $\frac{1}{4}$ rotation |
| 1/180 | 1/30 × 2/12 | 1/6 rotation |
| 1/360 | 1/30 × 1/12 | 1/12 rotation |

Figure 10:
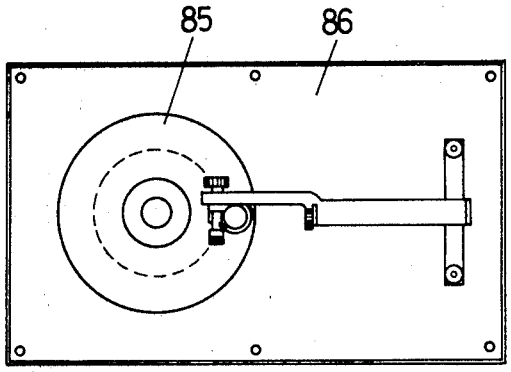
FIG. 10 is a plan view of the apparatus according to the invention, depicting the manner in which the apparatus is actually used.
Figure 11:
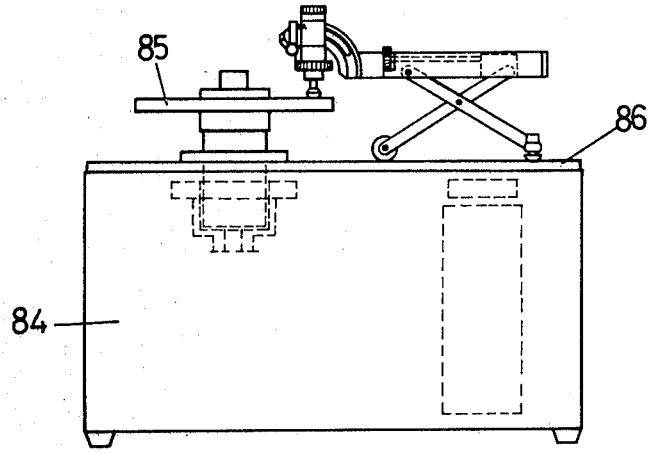
FIG. 11 is a front view of the apparatus in FIG. 10.

The angle of the faceter head can be set accurately by aligning the scale 37 on the faceter head mounting member 4 with a vernier scale 66 on the upper face of the portion 10 of the main bearing 9, FIG. 1. Untightening or loosening the nut 8 fixed to the shaft 6 permits the faceter head assembly to be released and moved in the directions of arrows 67 and 68 in FIG. 7. Then, a workpiece 69 to be faceted, such as a gemstone, is attached to the tip of the dop stick 31, which is in turn pushed into the collet chuck 26 with its pin 32 engaging the slot 29 in the collet chuck 26. The collet chuck 26 is immovably locked in a predetermined position by means of a key (not shown), thus holding the workpiece 69 in a secure position. Rotating the collet nut 27 in the direction of either of arrows 70 and 71, FIG. 8, causes the index gear 24 to rotate therewith by way of the main shaft 15. Engaging the projection 19*a* of the spring trigger 19 with the notches 24*a* of the index gear 24 by reading the scale 72 on the gear 24 provides a primary indexing function. In this operation, an indexing of 1/32 or 1/30 can be obtained according to the number of notches 24*a* of the index gear. Following the primary indexing operation, the control knob 13 is operated to rotate in the direction of either of arrows 73 and 74, FIG. 8, through a desired angle, so that the worm 14 can be rotated in the same direction by way of the worm shaft 12. Thus, the secondary indexing function is provided by the worm wheel 20, trigger ring 17 and spring trigger 19 which permit a fine adjustment of the index gear 24. The two operations, primary and secondary indexing functions, can provide a great number of indexes or sub-divisions for each of the index gear notches. Because of the smaller number of notches on the index gear (such as 30 or 32 notches) and the reproducibility of the rotation of the worm and worm gear which can be achieved with accuracy at any time by means of the control knob 13 on the worm shaft, it is advantageously possible to accomplish the complicated indexing operations with ease as well as with accuracy without requiring any experience in performing such operations. According to the invention, the center of a circle a peripheral section of which forms the arc of the arcuate-shaped aperture 3 or groove along which the faceter head supporting shaft is moved, is located in the same plane as the scale indicated side of the index gear and in the vicinity of a point at which the plane intersects the central axis of the dop stick. Therefore, the workpiece carried by the faceter head assembly can have extremely small changes in height irrespective to changes in the angle of the faceter head assembly. This construction can thus improve workability. In the embodiment shown in FIGS. 1 and 2, rotating the knob 73' in the direction of either of arrows 75 or 76 causes the rod 45 to rotate, thereby moving the sliding member 46 in the direction of either of arrows 77 or 78 so that the upper end of the foot link arm 47 attached to the sliding member 46 can be moved in the same direction. Thus, the intersecting angle of the arms 47 and 49 of the foot link changes, varying the height of the faceter frame. For instance, if the sliding member 46 is moved in the direction of arrow 77, the arms 47 and 49 are displaced from the solid-line position to the dot-dash line position, moving the faceter frame in a higher position. In FIGS. 10 and 11 of the drawings, reference numeral 84 denotes a grinder; 85, a lap; and 86 denotes a work table.

For the operation of the embodiment of FIGS. 4 and 5 enabling the height of the faceter frame to be adjusted, the position of the collar 64 is first appropriately determined, and the collar is fixed at a position of the stand rod 60. Then, the faceter frame is moved so that the vertical channel 59 of the member 68 can accommodate the stand rod 60 to be retained in position by the stand rod 60 and collar 64, as shown in FIG. 5. In this case, at the upper portion of the member 68 the permanent magnet 61 partly exposed in the channel can magnetically attract the stand rod with the lower end of the member 68 supported on the collar 64, and the faceter frame can therefore be stably supported. Then, rotating the control knob 63 in the direction of either of arrows 80 or 81 causes the slide nut 79 to move up or down by way of the threaded member 62 in the direction of either of arrows 82 or 83. The amount of the movement of the slide nut 79 in contact with the collar 64 will determine the height of the faceter frame accurately as desired. As described above, the member 68 and the stand rod 60 are connected by the magnetic attraction of the permanent magnet 61. This means that the resistance against a force exerted in a direction parallel with the exposed surface of the magnet, or in the direction of the movement of the member 68 is relatively small, whereas the resistance against a force applied perpendicular to the exposed surface of the magnet, or the pulling force applied to detach the two parts, is relatively strong. It will be readily understood from the above that the faceter frame can be supported firmly or stably despite its cantilever or one-side supported construction. When the faceter frame is to be removed from the stand rod, it is very easily done by a small lever-action force applied to move the lower end of the member 68 away from the stand rod with the upper end acting as fulcrum.

The apparatus according to the invention which has been illustrated presents a number of advantages which are partly derived from the dual indexing mechanism of the primary and auxiliary indexing means. It provides a large number of indexes with a small number of notches of the index gear, better workability, higher accuracy, and a higher-level faceting art which nevertheless does not require particular experience of the operator. The frame height adjusting means forming an integral part of the apparatus according to the invention permits a fine adjustment of the faceter frame to any desired height with a high degree of precision. Further, the stand-rod type adjusting means is advantageous in that it facilitates the mounting or dismounting of the faceter frame with respect to the supporting rod, and permits an easy positioning of the faceter frame at any desired height.

Although the present invention has been described by way of the preferred embodiments shown in the drawings, it should be understood that various changes and modifications may be made without departing from the scope and spirit of the invention.

What I claim is:

1. A faceting apparatus comprising:

a faceter frame;

means connected to said faceter frame for adjusting the relative vertical height thereof;

a member extending outwardly from an end of said faceter frame, said member having therein an arcuate-shaped channel and an arcuate-shaped aperture, said channel and said aperture having coaxial centers of curvature;

an interchangeable faceter head assembly including a main bearing, an index gear having spaced entirely around the circumference thereof a plurality of circumferentially spaced index positions and rotatable with respect to said main bearing about a first axis extending orthogonally of a horizontal second axis extending through said coaxial centers of curvature;

means for mounting said faceter head assembly on said member for selective movement along said arcuate aperture and channel such that said faceter head assembly rotates about said horizontal second axis, said mounting means solely comprising elements extending into said arcuate aperture and channel, and the area of said horizontal second axis being totally free of said mounting means;

workpiece supporting means, fixed with respect to said index gear coaxially thereof, for supporting a work-piece closely adjacent said horizontal second axis;

primary indexing means for rotating said index gear about said first axis between said circumferentially spaced index positions; and secondary indexing means, operatively connected to said index gear, for rotating said index gear about said first axis by increments of the pitch between two adjacent said index positions, said secondary indexing means comprising a trigger ring rotably mounted about said main bearing coaxially of said first axis, trigger means supported by said trigger ring for engaging a said index position of said index gear, a worm wheel fixed to said trigger ring, and worm means engaging said worm wheel for selectively rotating said trigger ring, said trigger means and thereby said index gear about said first axis.

2. An apparatus as claimed in claim 1, wherein said mounting means comprises a supporting shaft extending from said faceter head assembly through said arcuate aperture.

3. An apparatus as claimed in claim 2, wherein said mounting means further comprises an arcuate guide member integral with and extending outwardly from said faceter head assembly, said arcuate guide member slidably fitting into said arcuate channel.

4. An apparatus as claimed in claim 1, wherein said faceter frame comprises a horizontally extending channel-shaped member, and said height adjusting means comprises a threaded member disposed in the channel of said channel-shaped member, a sliding block slidably positioned within said channel and connected to said threaded member, an X-shaped link assembly including first and second arms pivoted to each other at a central pivot, said first arm having a first end pivoted to said faceter frame, said second arm having a first end pivoted to said sliding block, said arms having at second ends thereof separate foot supporting means, and control means connected to said threaded member for rotating said threaded member, for thereby causing said sliding block to move horizontally within said channel, for thereby causing said second arm to pivot about said central pivot with respect to said first arm, and for thereby altering the height of said faceter frame.

5. An apparatus as claimed in claim 4, wherein said foot supporting means of one of said arms comprises a roller, and said foot supporting means of the other of said arms comprises a horizontal element connected to said second end of said other arm, and level adjusting means connected to each of opposite ends of said horizontal element.

6. An apparatus as claimed in claim 1, wherein said height adjusting means comprises a stationary stand rod, a vertical member attached to said faceter frame, said vertical member having therein a channel receiving said stand rod, and permanent magnet means within said vertical member and partially exposed to said channel for attaching said vertical member and thereby said faceter frame to said stand rod.

7. An apparatus as claimed in claim 6, wherein said height adjusting means further comprises a vertically movable contact element within said vertical member, and a collar on said stand rod and supporting said contact element, such that relative vertical movement of said contact element with respect to said vertical member will result in vertical movement of said vertical member and said faceter frame with respect to said collar and said stand rod.

8. An apparatus as claimed in claim 7, wherein said height adjusting means further comprises a vertical threaded rod within said vertical member, and means threadedly engaging said threaded rod and carrying said contact element.

9. An apparatus as claimed in claim 6, wherein said permanent magnet means is located at an upper portion of said vertical member.

10. An apparatus as claimed in claim 6, further comprising means for attaching said stand rod at a bottom portion thereof to a work table.

11. An apparatus as claimed in claim 1 wherein said first and second axes intersect at a position on said index gear at an axial end thereof adjacent the workpiece.

* * * * *